US008056679B2

(12) United States Patent
Hong

(10) Patent No.: US 8,056,679 B2
(45) Date of Patent: Nov. 15, 2011

(54) RETRACTABLE LADDER

(76) Inventor: Rong-Tai Hong, Kaohsiung (TW)

( * ) Notice: Subject to any disclaimer, the term of this patent is extended or adjusted under 35 U.S.C. 154(b) by 316 days.

(21) Appl. No.: 12/538,932

(22) Filed: Aug. 11, 2009

(65) Prior Publication Data

US 2011/0036666 A1 Feb. 17, 2011

(51) Int. Cl.
*E06C 1/00* (2006.01)

(52) U.S. Cl. ..... 182/195; 182/209

(58) Field of Classification Search ..... 182/195, 182/207, 209
See application file for complete search history.

(56) References Cited

U.S. PATENT DOCUMENTS 2,194,856 A * 3/1940 Kostuk ..... 182/126
2,827,216 A * 3/1958 Napolitano ..... 182/104
2,975,857 A * 3/1961 Suroff et al. ..... 182/166
4,989,692 A * 2/1991 Min ..... 182/166
5,738,186 A * 4/1998 Jones ..... 182/195
7,316,293 B2 * 1/2008 Yao et al. ..... 182/195
2009/0065304 A1 * 3/2009 Jian ..... 182/209
2010/0044155 A1 * 2/2010 Kieffer et al. ..... 182/195

* cited by examiner

*Primary Examiner* — Alvin Chin Shue
(74) *Attorney, Agent, or Firm* — Whyte Hirschboeck Dudek SC

(57) ABSTRACT

A retractable ladder includes telescoping rail sections each having left and right side rail members. Each side rail member has two aligned locking holes. A control device includes a shaft disposed rotatably between the side rail members of one of the rail sections, and two locking units each having a controlled piece fixed to and rotatable along with the shaft, two abutment plates, two locking pins, and two spring members biasing the abutment plates to abut respectively against two opposite sides of the controlled piece. The controlled piece is rotatable between a pushing position to push the locking pins to project outwardly from the locking holes in said one of the rail sections and engage respectively the locking holes in the adjacent rail section, and a non-pushing position, where the locking pins are permitted to extend inwardly so as to disengage from the locking holes in the adjacent rail section.

5 Claims, 8 Drawing Sheets

RETRACTABLE LADDER

BACKGROUND OF THE INVENTION

1. Field of the Invention

This invention relates to a ladder, more particularly to a retractable ladder.

2. Description of the Related Art

A ladder is commonly used for retrieving an article that is stored in a high place or for repairing something that is positioned at a substantial height. A conventional ladder mainly includes two spaced-apart upright rods, and a plurality of spaced-apart cross plates fixed between the upright rods. Although this kind of ladder can achieve its intended purpose, it cannot be folded for storage, so that the conventional ladder is either leant vertically on a wall or is placed horizontally on the ground, thereby occupying a substantial space when not in use. Further, people passing by the conventional ladder may easily trip over the ladder and get injured. Moreover, because the conventional ladder is long and is not retractable, it cannot be placed inside a trunk or passenger compartment of a car. Hence, the conventional ladder is very inconvenient to store, transport, and carry. Additionally, since the conventional ladder is not retractable, the user must purchase ladders of different heights so as to be prepared for various height circumstances.

SUMMARY OF THE INVENTION

Therefore, the object of the present invention is to provide a retractable ladder that does not occupy a substantial space during storage and that can be adjusted to a suitable height as needed.

According to this invention, a retractable ladder comprises a plurality of telescoping rail sections and at least one control device. Each rail section has left and right side rail members. Each of the left and right side rail members has two opposite lateral sides, and two aligned locking holes provided respectively in the lateral sides. The control device includes a shaft disposed rotatably between the left and right side rail members of one of the rail sections, two locking units disposed respectively on two opposite ends of the shaft to lock movement of the one of the rail sections relative to an adjacent one of the rail sections, and an operating member fixed between the two opposite ends of the shaft to rotate the shaft. Each of the locking units has a controlled piece fixed to and rotatable along with the shaft, two abutment plates abutting respectively against two opposite sides of the controlled piece, two locking pins extending outwardly and respectively from the abutment plates, and two spring members sleeved respectively on the locking pins and biasing the abutment plates to abut respectively against the two opposite sides of the controlled piece. The controlled piece is rotatable between a pushing position to push the locking pins to project outwardly and respectively from the locking holes in the one of the rail sections and engage respectively the locking holes in the adjacent one of the rail sections, and a non-pushing position, where the locking pins are permitted to extend inwardly so as to disengage from the locking holes in the adjacent one of the rail sections.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
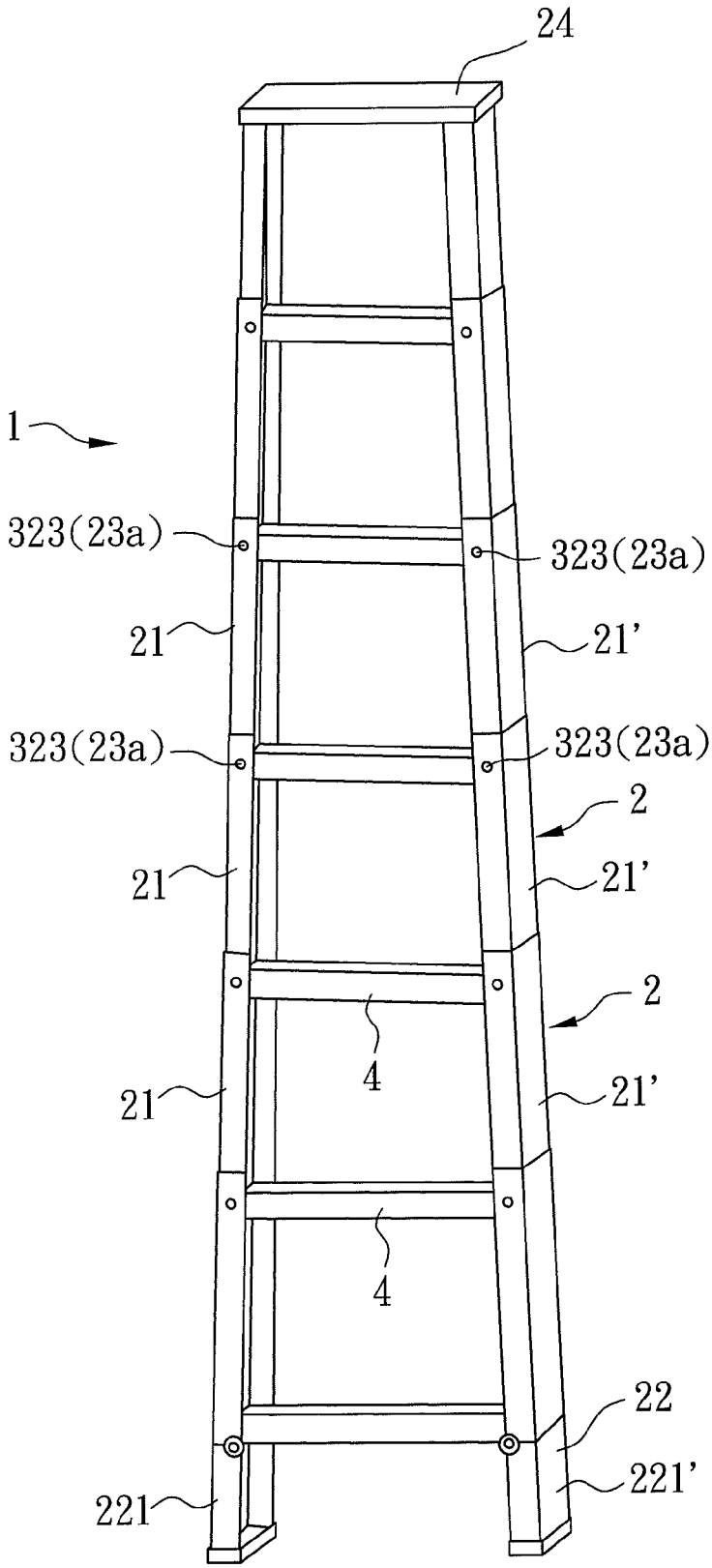
FIG. 1 is a perspective view of a retractable ladder according to the preferred embodiment of the present invention in a fully extended state.
Figure 2:
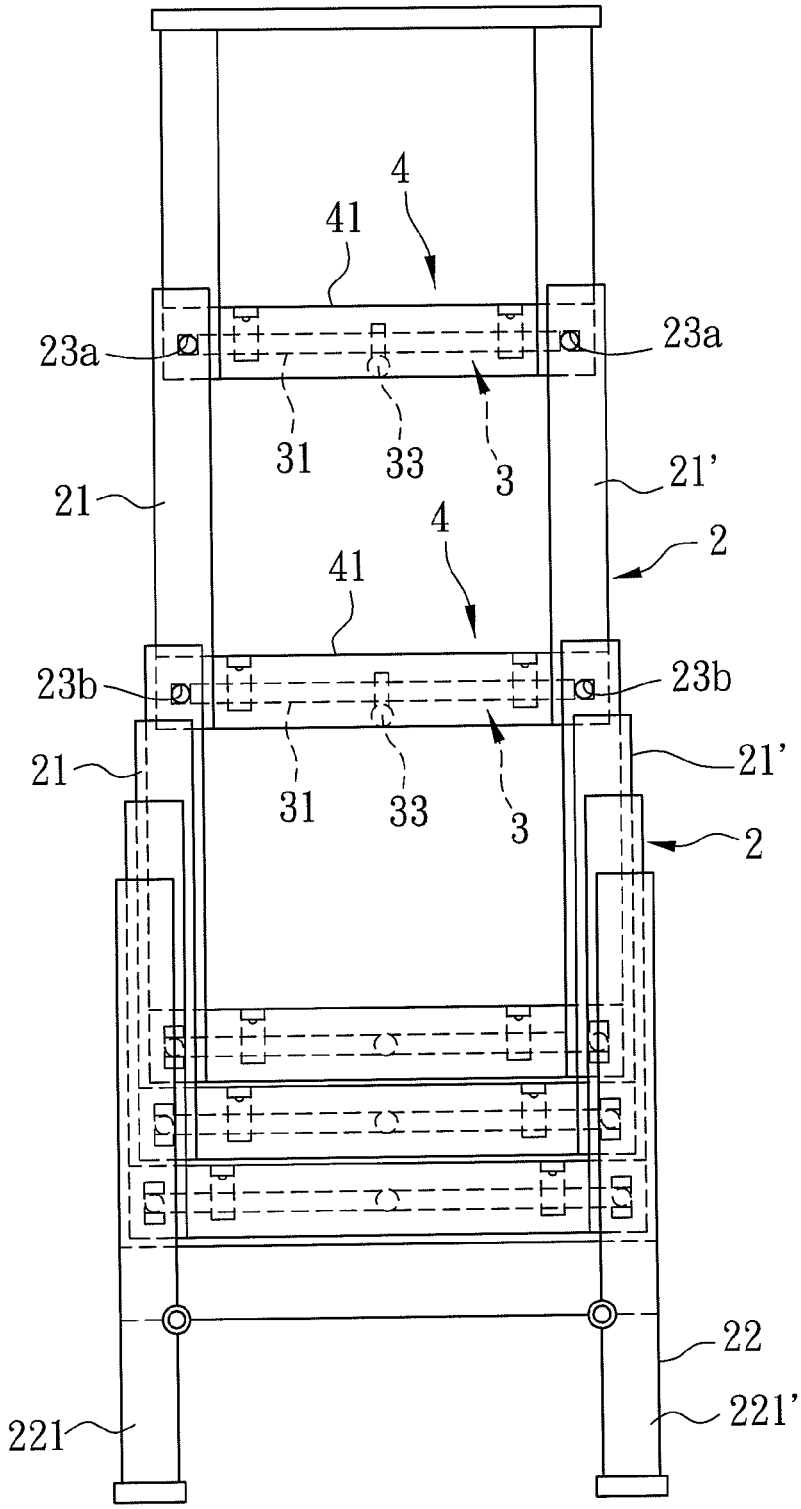
FIG. 2 is a schematic front view of the preferred embodiment, illustrating how telescoping rail sections can be retracted one at a time.

Referring to FIGS. 1 to 6, a retractable ladder 1 according to the preferred embodiment of the present invention is shown to comprise a plurality of telescoping rail sections 2, a bottom rail section 22, a seat plate 24, and a plurality of control devices 3 (see FIG. 2).

Each of the rail sections 2 has left and right side rail members 21, 21', and a step frame unit 4 between the left and right side rail members 21, 21'. Each of the left and right side rail members 21, 21' has two opposite lateral sides 211, 211', two aligned upper locking holes (23*a*) formed respectively in the lateral sides 211, 211' at a top end portion thereof, and two aligned lower locking holes (23*b*) formed respectively in the lateral sides 211, 211' at a bottom end portion thereof. Each of the left and right side rail members 21, 21' has a U-shaped cross section in this embodiment, but is not limited thereto.

Figure 6:
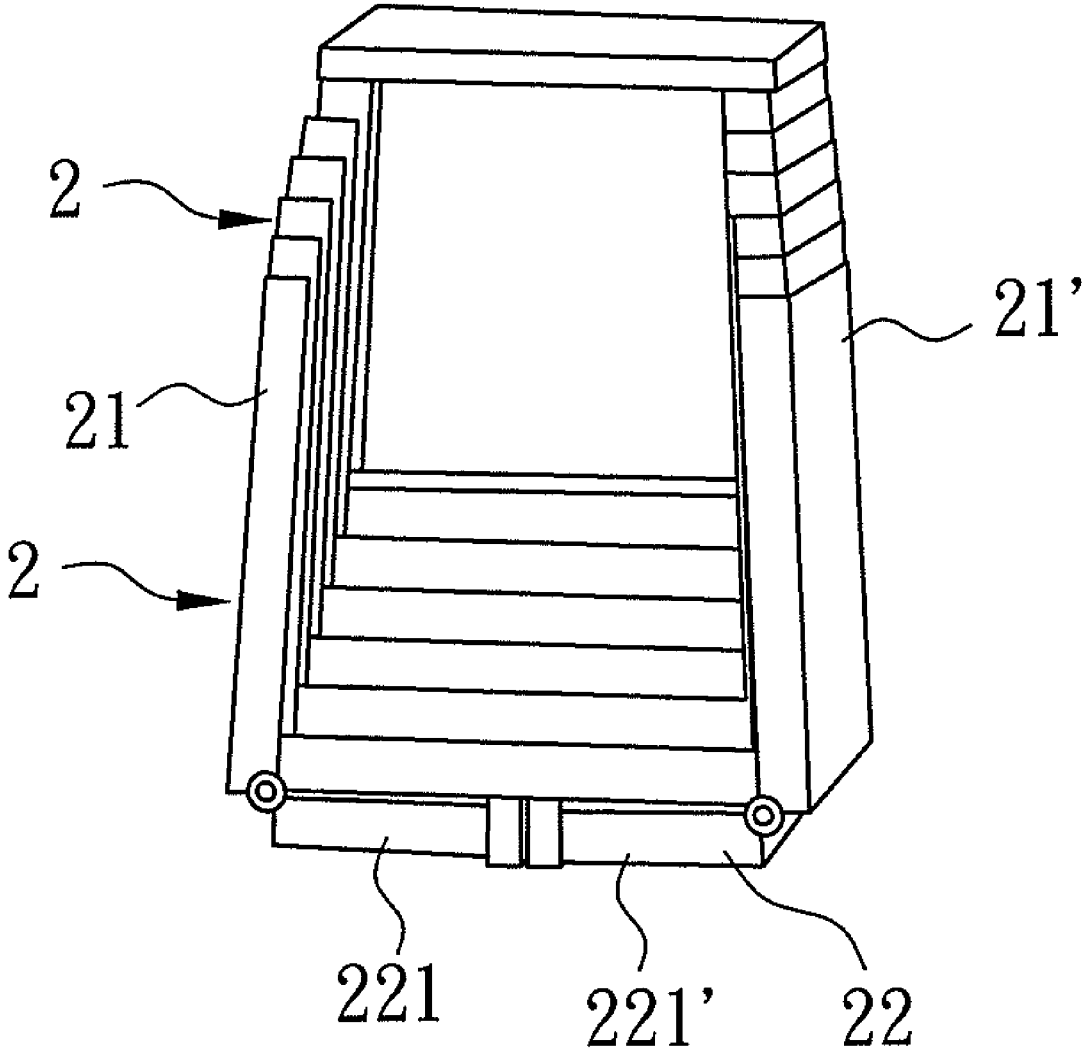
FIG. 6 is a perspective view of the preferred embodiment in a completely retracted state.

The bottom rail section 22 has left and right bottom rail members 221, 221' connected pivotally and respectively to the left and right side rail members 21, 21' of a bottommost one of the rail sections 2 such that the left and right bottom rail members 221, 221' can be folded inwardly relative to the respective left and right side rail members 21, 21' of the bottommost one of the rail sections 2, as best shown in FIG. 6.

The seat plate 24 interconnects top ends of the left and right side rail members 21, 21' of an uppermost one of the rail sections 2.

Each of the control devices 3 is provided on a respective rail section 2, and has a shaft 31 disposed rotatably between the left and right side rail members 21, 21' of the respective rail section 2, two locking units 32 disposed respectively on two opposite ends of the shaft 31, and an operating member 33 fixed between the ends of the shaft 31. Each locking unit 32 includes an elongated controlled piece 321 fixed to and rotatable along with the shaft 31, two abutment plates 322 abutting respectively against two opposite sides of the controlled piece 321, two locking pins 323 extending outwardly and respectively from the abutment plates 322 into the lower locking holes (23*b*) in the left or right side rail member 211, 211' of the respective rail section 2, and two spring members 324 respectively sleeved on the locking pins 323 and biasing the abutment plates 322 to abut respectively against the two opposite sides of the controlled piece 321.

Figure 3:
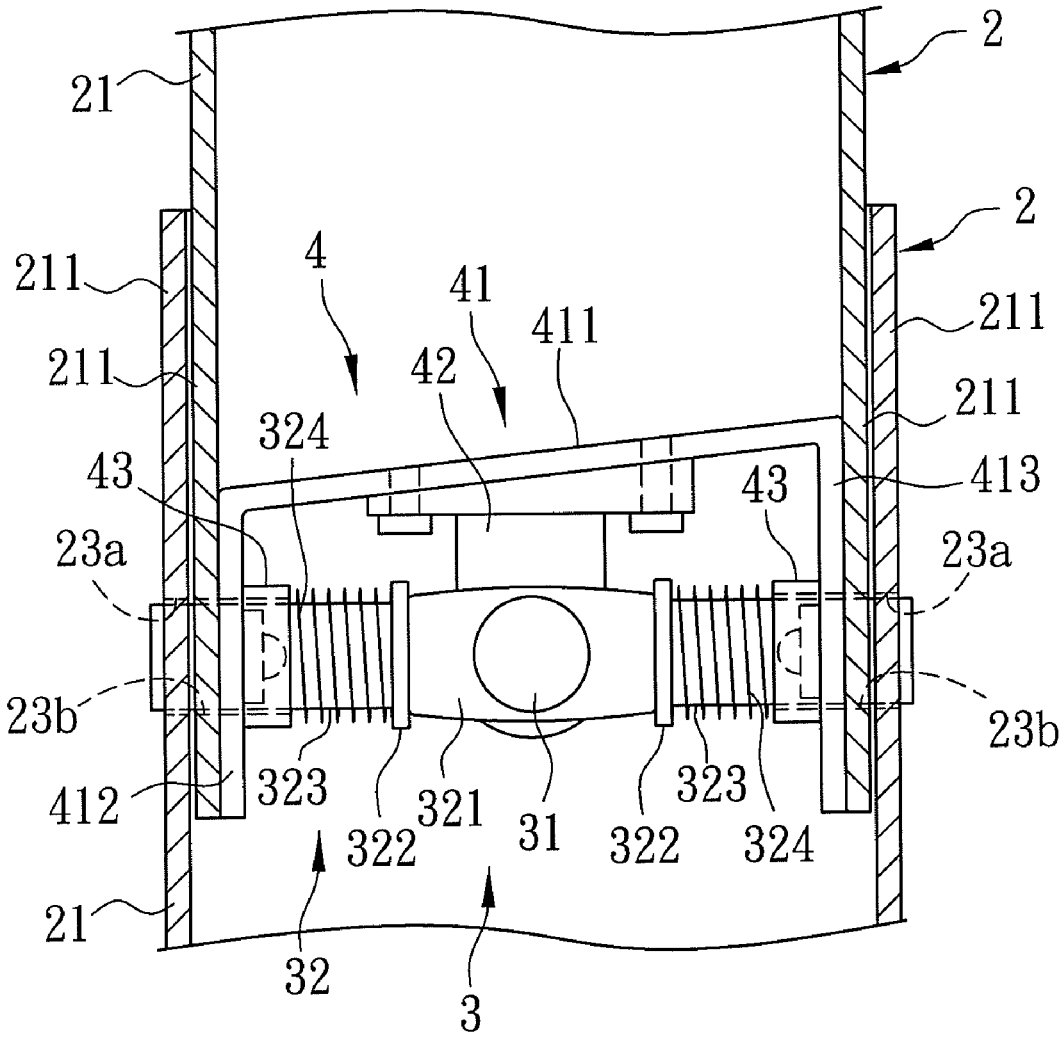
FIG. 3 is a fragmentary enlarged sectional view of the preferred embodiment, illustrating a controlled piece of a control device in a pushing position.

The operating member 33 is in the form of a knob, and is operable to rotate the shaft 31 to thereby rotate simultaneously the controlled piece 321 of each locking unit 32 between a pushing position and a non-pushing position. In the pushing position, as shown in FIG. 3, the elongated controlled piece 321 is disposed horizontally to push the locking pins 323 to project outwardly and respectively from the lower locking holes (23*b*) in one of the rail sections 2 and engage respectively the upper locking holes (23*a*) in an adjacent rail section 2 so as to place said one of the rail sections 2 in an extended state relative to the adjacent rail section 2. In the non-pushing position, as shown in FIG. 4, the elongated controlled piece 321 is disposed vertically to permit the locking pins 323 to extend inwardly so as to disengage from the upper locking holes (23*a*) in the adjacent rail section 2, thereby placing said one of the rail sections 2 in a retracted state relative to the adjacent rail section 2.

The step frame unit 4 of each rail section 2 includes an inverted U-shaped step frame 41, two shaft-supporting plates 42, and four sleeve members 43. The inverted U-shaped step frame 41 is connected between the left and right side rail members 21, 21' of a corresponding rail section 2, is mounted over and covering the shaft 31, and has two spaced-apart front and rear walls 412, 413 (see FIGS. 3 and 4), and a top wall 411 between the front and rear walls 412, 413. The front and rear walls 412, 413 are fixed to the lateral sides 211, 211' of the left and right side rail members 21, 21' of the corresponding rail section 2 by using fasteners, such as rivets, screws, or the like. The top wall 411 is inclined with respect to a horizontal plane to facilitate stepping of a user. The shaft-supporting plates 42 are fixed to and extend downwardly and respectively from left and right ends of the top wall 411. Two of the sleeve members 43 are fixed respectively to two opposite ends of the front wall 412, while the other two of the sleeve members 43 are fixed respectively to two opposite ends of the rear wall 413. Each spring member 324 has two opposite ends abutting respectively against one of the abutment plates 322 and a corresponding sleeve member 43. The two opposite ends of the shaft 31 are connected respectively to the shaft-supporting plates 42.

Figure 5:
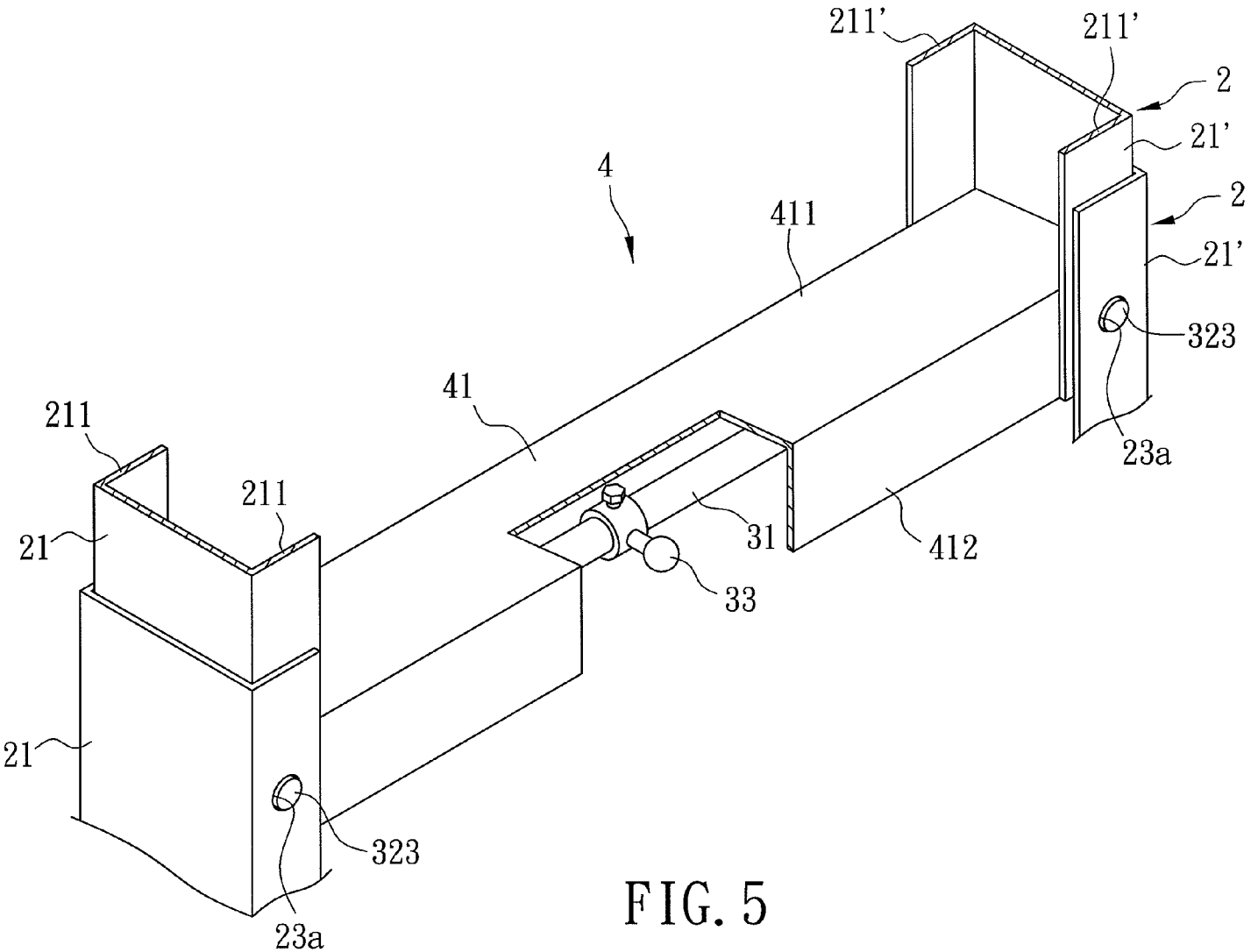
FIG. 5 is a fragmentary enlarged perspective view of the preferred embodiment with a middle part of a step frame removed for clarity's sake.

With reference to FIGS. 3 and 5, in use, the lower fixing holes (23*b*) in the left and right side rail members 211, 211' of said one of the rail sections 2 are first placed in alignment with the upper fixing holes (23*a*) in the left and right side rail members 2 of the adjacent rail section 2 so as to communicate spatially and respectively with each other, after which the operating member 33 is operated to rotate the shaft 31 and move the controlled pieces 321 of the locking units 32 simultaneously to the pushing positions, thereby placing said one of the rail sections 2 in the extended state relative to the adjacent rail section 2.

Figure 4:
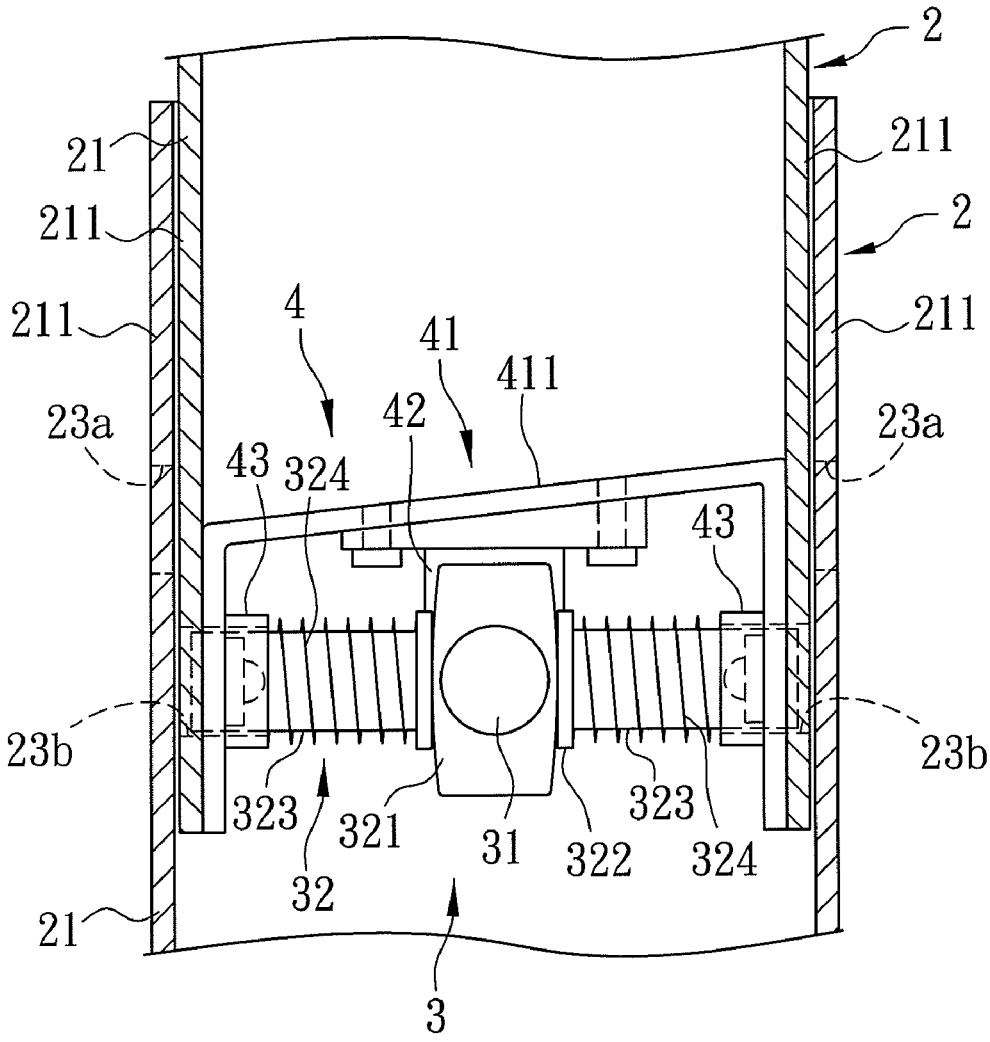
FIG. 4 is a view similar to FIG. 3, but illustrating the controlled piece of the control device in a non-pushing position.

With reference to FIGS. 4 and 5, to retract said one of the rail sections 2 relative to the adjacent rail section 2, the operating member 33 is operated again to rotate the shaft 31 and move the controlled piece 321 vertically to the non-pushing position.

Hence, by operating the operating member 33, each rail section 2 can be placed either in the extended state or in the retracted state, so that the user can adjust the retractable ladder 1 to a fully extended state, as shown in FIG. 1, to a completely retracted state, as shown in FIG. 6, or to a length as needed between the fully extended and retracted states.

From the aforesaid description, the advantages of the retractable ladder 1 of the present invention can be summarized as follows:

1. By altering the elongated controlled piece 321 of each locking unit 32 between the pushing and non-pushing positions, and through cooperation of the spring members 324, the locking pins 323 can engage with and disengage from the upper locking holes (23*a*) in the adjacent rail section 2, so that extension and retraction of each rail section 2 of the retractable ladder 1 can be achieved. Further, the components of the retractable ladder 1 are simple.

2. The user simply operates the operating member 33, which is fixed to the shaft 31, to alter the position of controlled piece 321 of each locking unit 32 to thereby achieve extension or retraction of each rail section 2 of the retractable ladder 1. Hence, operation of the retractable ladder is simple and easy.

3. The inverted U-shaped step frame 41 of the step frame unit 4 of each rail section 2 covers and hides each control device 3, thereby enhancing the appearance of the retractable ladder 1.

Figure 7:
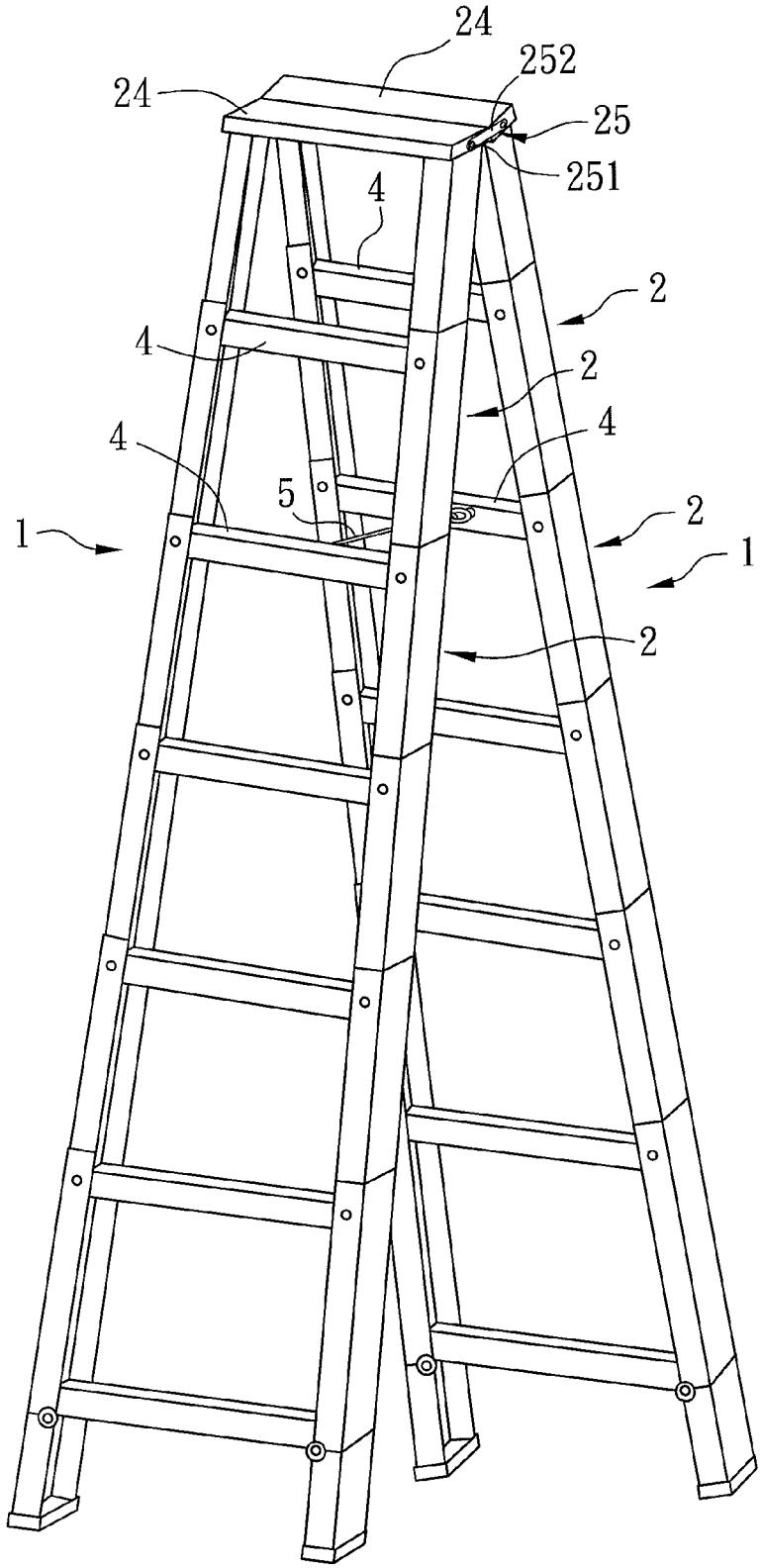
FIG. 7 is a perspective view of a twin step ladder incorporating two retractable ladders of the present invention.
Figure 8:
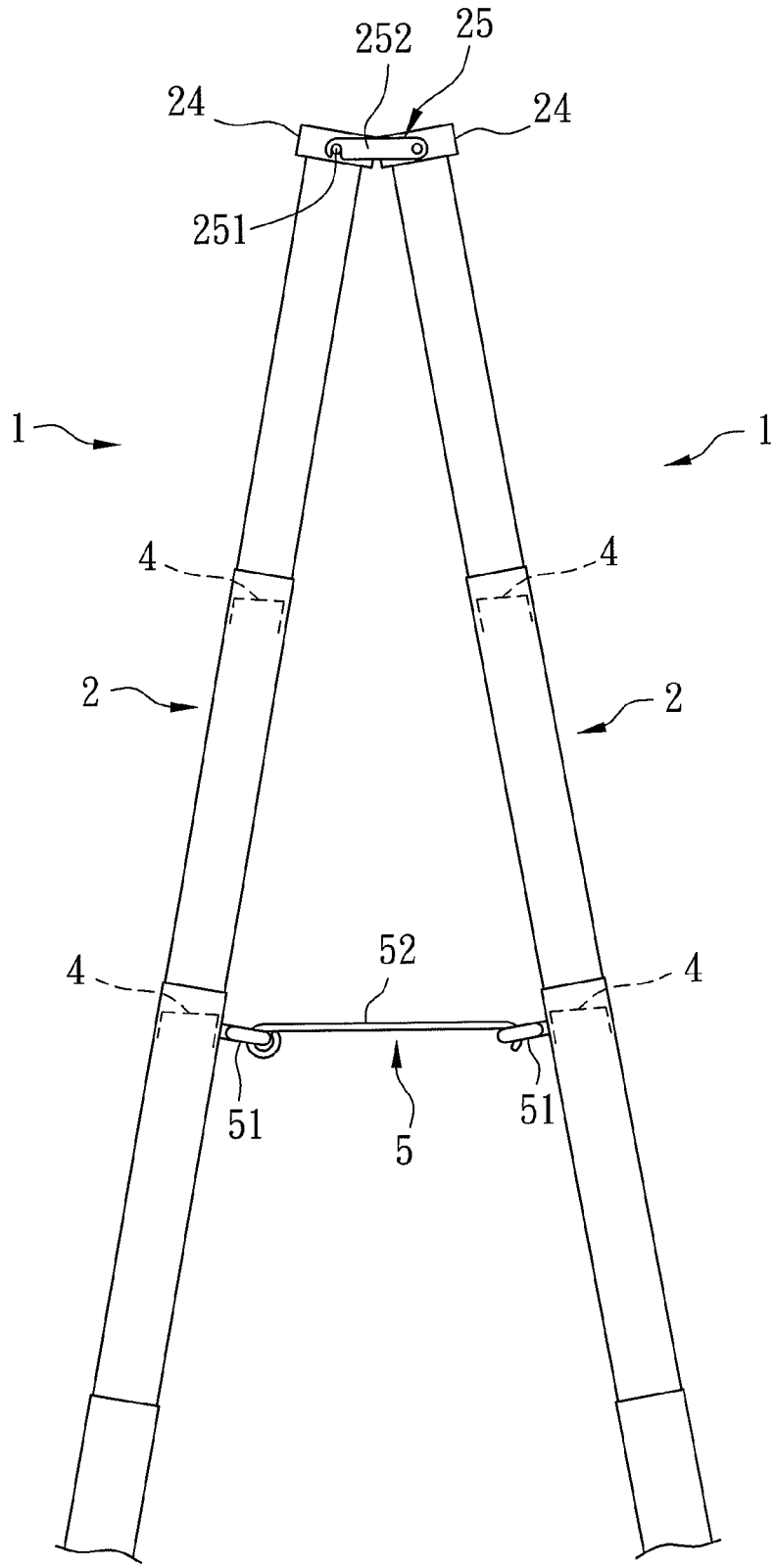
FIG. 8 is a fragmentary schematic side view of FIG. 7.

Referring to FIGS. 7 and 8, a twin step ladder is shown to comprise two retractable ladders 1 of the present invention, left and right interlocking units 25 (only the right interlocking unit 25 is visible in FIGS. 7 and 8) for interconnecting the seat plates 24 or top ends of the retractable ladders 1, and a retaining unit 5. The right interlocking unit 25 includes a projection 251 fixed to the seat plate 24 of one of the retractable ladders 1, and a hooking element 252 connected pivotally to the seat plate 24 of the other one of the retractable ladders 1 and hooked engagingly to the projection 251. The hooking element and the projection of the left interlocking unit are disposed opposite to the hooking element 251 and the projection 26 of the right interlocking unit 25. The retaining unit 5 includes two engaging rings 51 connected respectively to the step frame units 4 of the rail sections 2 of the retractable ladders 1 that correspond to each other in position, and an engaging hook 52 hooked engagingly between the engaging rings 5. The twin step ladder can be similarly extended and retracted.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A retractable ladder comprising:

a plurality of telescoping rail sections each having left and right side rail members, each of said left and right side rail members having two opposite lateral sides, and two aligned locking holes provided respectively in said lateral sides; and at least one control device including a shaft disposed rotatably between said left and right side rail members of one of said rail sections, two locking units disposed respectively on two opposite ends of said shaft to lock movement of said one of said rail sections relative to an adjacent one of said rail sections, and an operating member fixed between said two opposite ends of said shaft to rotate said shaft, each of said locking units having a controlled piece fixed to and rotatable along with said shaft, two abutment plates abutting respectively against two opposite sides of said controlled piece, two locking pins extending outwardly and respectively from said abutment plates, and two spring members sleeved respectively on said locking pins and biasing said abutment plates to abut respectively against said two opposite sides of said controlled piece;

said controlled piece being rotatable between a pushing position to push said locking pins to project outwardly and respectively from said locking holes in said one of said rail sections and engage respectively said locking holes in said adjacent one of said rail sections, and a non-pushing position, where said locking pins are permitted to extend inwardly so as to disengage from said locking holes in said adjacent one of said rail sections.

2. The retractable ladder of claim 1, further comprising a bottom rail section having left and right bottom rail members connected pivotally and respectively to said left and right side rail members of a bottommost one of said rail sections.

3. The retractable ladder of claim 2, further comprising a seat plate interconnecting top ends of said left and right side rail members of an uppermost one of said rail sections.

4. The retractable ladder of claim 3, wherein each of said rail sections further has an inverted U-shaped step frame, two shaft-supporting plates, and a plurality of sleeve members, said inverted U-shaped step frame being connected between said left and right side rail members of a corresponding one of said rail sections, being mounted over and covering said shaft, and having two spaced-apart front and rear walls, and a top wall between said front and rear walls, said shaft-supporting plates being fixed to and extending downwardly and respectively from left and right ends of said top wall, said sleeve members being fixed respectively to said front and rear walls for extension of said locking pins respectively therethrough, each of said spring members having two opposite ends abutting respectively against one of said abutment plates and a corresponding one of said sleeve members, said two opposite ends of said shaft being connected respectively to said shaft-supporting plates.

5. The retractable ladder of claim 4, wherein said top wall is inclined with respect to a horizontal plane.

* * * * *